United States Patent [19]

Laukien

[11] 4,411,213

[45] Oct. 25, 1983

[54] TWIN-HULL WATERCRAFT

[76] Inventor: Günther R. Laukien, Silberstreifen, D 7512 Rheinstetten-Forchheim, Fed. Rep. of Germany

[21] Appl. No.: 182,471

[22] Filed: Aug. 28, 1980

[30] Foreign Application Priority Data

Sep. 21, 1979 [DE] Fed. Rep. of Germany ..... 2938319

[51] Int. Cl.[3] ..... B63H 8/00; B63H 8/04; B63H 8/22

[52] U.S. Cl. ..... 114/312; 114/61; 114/333

[58] Field of Search ..... 114/61, 312, 333–335, 114/337–339, 342

[56] References Cited

U.S. PATENT DOCUMENTS

| | | | |
|---|---|---|---|
| 1,175,219 | 3/1916 | Barraga-Frauenfelder | 114/333 |
| 1,757,174 | 5/1930 | Douglas | 114/61 |
| 2,859,721 | 11/1958 | Endrezze | 114/312 |
| 3,102,504 | 9/1963 | Sato | 114/333 |
| 3,104,641 | 9/1963 | Froehlich | 114/338 X |
| 3,561,387 | 2/1971 | Kumm | 114/312 |
| 4,333,414 | 6/1982 | Hauz | 114/333 |

*Primary Examiner*—Sherman D. Basinger
*Attorney, Agent, or Firm*—Murray Schaffer

[57] ABSTRACT

A twin-hull watercraft in which the two hulls are disposed parallel to and spaced apart from each other and rigidly connected by means of tubular struts. The hulls and struts take the form of tight pressure vessels which are provided with cells that can be flooded and blown. A pilot's cab designed as a third pressure vessel is arranged on a vertical superstructure above the hulls, approximately in the longitudinal center plane.

17 Claims, 5 Drawing Figures

TWIN-HULL WATERCRAFT

BACKGROUND OF THE INVENTION

The present invention relates to a twin-hull watercraft having two hulls which are disposed parallel to and spaced apart from each other, which are rigidly interconnected by means of tubular struts, which have propulsion and control units and which are adapted to accommodate between them a submersible craft, a diver work chamber or other operating equipment. A pilot's cab with a steering stand for the craft is rigidly connected with the hulls and disposed above the hulls, approximately in the longitudinal center plane. The hulls and the connections between the hulls and the pilot's cab being at least partly designed as pressure-resistant buoyancy bodies in that their weight is less than the weight of water displaced by them, and the hulls being designed as tight pressure vessels of the type of submarines and provided with cells that may be flooded and blown. The pilot's cab takes the form of a third pressure vessel which is equipped with pressure-resistant view ports and which can function as a buoyancy body in that its weight is less than the weight of water it displaces in the submerged condition. The twin-hull watercraft is weight-stable both in the fully submerged condition and also in the partially submerged condition, when the pilot's cab is still completely or partly above the mean waterline so that it can be used both as a form-stable surface-bound watercraft and as a weight-stable semisubmersible craft or a weight-stable submersible craft an egress to the outside for divers is provided on one of the connections between the hulls and/or the pilot's cab.

The above-described submersible catamaran distinguishes itself by its versatility in subsea service. Another advantageous property is to be seen in its large work radius in surface use and in the fact that as a semisubmersed or completely submersed craft it can be used under a wide variety of weather conditions.

It is the object of the present invention to improve such a submersible craft as regards its service properties, in particular as regards its driving qualities, work radius and suitability for heavy sea conditions.

SUMMARY OF THE INVENTION

According to the invention, this object is achieved in a craft of the type described above in that the hulls are directly interconnected by means of at least one transverse connection, and that the pilot's cab is connected and fastened to one transverse connection by means of at least one load-carrying connection disposed in the longitudinal center plane of the craft.

The transverse connection of the hulls realized in a manner known as such in catamarans improves considerably the strength of the whole arrangement, a fact which is of particular importance in surface use and under heavy sea conditions. By the direct connection of the two hulls and the resulting possibility to attach the pilot's cab by means of a load-carrying connection disposed in the longitudinal center plane of the craft, the resistance to motion in the semisubmerged and completely submerged conditions can be considerably reduced because of the reduced cross-sectional area of the submerged connections (although the vertical connection is only little shorter than the oblique connection, the transverse connection is considerably shorter than the corresponding oblique connection). The arrangement of the transverse connections is such that in the surfaced condition of the craft they are at least partly above the waterline. Preferably, the transverse connections and the hulls form together a portal, viewed in the driving direction. For instance, the transverse connections may extend from the hulls at an angle of 45°, relative to the horizontal line, and then pass over into a horizontal central portion carrying the vertical connection. The transverse connections do not impair the accommodation of working outfit between the hulls, but in contrast they improve the possibilities of mounting and supplying working equipment with the necessary energy, etc. In a preferred embodiment of the invention, the transverse connection and/or the hulls are therefore provided with connections for the attachment and supply of working outfit such as subsea welding chambers and subsea working chambers to be accommodated in the space between the the transverse connections and the hull. This makes the craft of the invention extremely versatile for subsea work. In addition, it may accommodate between its hulls an autonomous submersible craft. This possibility is also not impaired by the transverse connections because experience showed that a submersible craft may enter the space between the transverse connections and the hulls from below (with the craft in the completely or partially submerged condition), without this action being seriously obstructed or jeopardized by heavy sea conditions.

In a preferred embodiment of the invention, the connections are provided with a streamlined fairing to reduce the resistance to motion, and the fairing of the transverse connections and/or of the vertical connections is designed to incorporate at least part of the working outfit. In this latter case, the fairings are preferably hinged. They are not tight but serve merely the purpose to produce a streamlined outer contour. So they can be realized on the one hand without excessive cost while on the other hand they act to increase the economically achievable driving speed in all driving conditions (surfaced, semisubmerged or submerged). In addition, the work radius of the craft is increased in this manner.

According to a preferred embodiment of the invention, the hulls comprise a cylindrical pressure vessel with ballast tanks disposed on its top and bottom, the ballast tanks being closed to the outside by coverings which are not pressure-resistant. They serve to regulate the buoyancy. The arrangement of the ballast tanks on top and below the pressure vessel has a favourable influence on the stability of the craft. In a preferred embodiment of the invention, the upper ballast tanks are in the surfaced condition of the craft above its mean waterline. In this position, they do not contribute to the buoyancy, but to the form-stability of the craft when used as a surface craft. On the other hand, the ballast tanks are preferably sized so that in the semisubmerged condition the lower ballast tanks are fully and the upper ballast tanks are partly flooded. This gives the craft the necessary weight stability in the semisubmerged condition. It is an advantage of this arrangement that under rough sea conditions the buoyancy of the craft will change only little between the wave crests and the wave troughs since the cross section of the vertical connection which gets more or less submerged is relatively small. As a result, buoyancy variations are relatively unimportant, and the craft is relatively stable as regards its vertical movements, even under rough sea conditions. On the other hand, however, the position of the mean water-line is relatively instable. Even unimportant load variations, caused for instance by trailing loads, result already in considerable variations of the means water-line until they are balanced by additionally flooded or blown ballast tanks.

Therefore, a preferred embodiment of the invention has incorporated into the connection carrying the pilot's cab, and in parallel to the hulls, an additional hull which in the semisubmerged condition of the craft is partially submerged and which takes the form of a pressure-resistant buoyancy body having a weight lower than the weight of the water displaced by it in the fully submerged condition. This additional hull is arranged substantially midway between the hulls and the pilot's cab and of elongated design which gives it the shape of a surface-bound craft. Due to its large cross-section in the water-line, this additional hull acts to stabilize the position of the semisubmerged craft in the vertical sense. On the other hand, the additional hull does not considerably increase the resistance to motion, due to its slim line. The wave resistance and frictional resistance remain low, which considering a given motive power has a favourable influence on the surface and subsea speed and also on the work radius of the craft. So, the craft of the invention may travel in semisubmerged condition, a fact which proves advantageous in many respects and improves the independence of the existing weather conditions.

The additional hull permits a number of additional advantageous embodiments. In one embodiment, a diver exit chamber is provided in one of the transverse connections or, alternatively, in the additional hull. This diver exit chamber is provided with a closable lateral or upper docking port, either in addition to or in place of the downwardly opening egress for divers. This permits the attachment, operation and detachment of small submersible craft, in particular semi-autonomous craft or working chambers.

In a preferred embodiment of the invention in which the craft is provided with an additional hull, the latter is equipped with control tanks for controlling the water-line level in the semi-submerged condition of the craft. The water-line extends a short way below the upper edge of the additional hull, which means that the main hulls are completely submerged while the pilot's cab is at several meter's distance above the water surface. The craft is weight-stable and stabilized by the buoyancy of the control tanks.

In the design of the craft comprizing an additional hull, the hulls preferably also comprise a cylindrical pressure vessel; the cylindrical pressure vessels are surrounded by concentrically arranged ballast tanks covered at their outsides by a fairing which is not tight but defines the outer configuration. This fairing gives the desired streamlined outer contour. The concentric arrangement of the ballast tanks permits the production thereof at low cost and in addition no space is required for the ballast tanks within the pressure vessel. The ballast tanks are designed to ensure that in their blown condition the water-line of the surfaced craft is substantially flush with the upper portion of the cylindrical pressure vessel. As a result thereof, a favourable wave resistance is achieved also during surface travel (similar to the wave resistance of a submarine when travelling in the surfaced condition). On the other hand, the size of the ballast tanks is such that when flooded they bring the craft into the semisubmerged condition when the control tanks in the additional hull are simultaneously blown. In this condition, the control tanks of the additional hull ensure a very stable semisubmerged condition of the craft. According to a preferred embodiment of the invention, their volume is larger than the buoyancy of the craft in its semisubmerged position so that partial flooding of the control tanks will submerge the craft.

During the submerging process, the craft gets out of trim in the longitudinal direction when the pilot's cab submerges as the latter is designed as a buoyancy body and gives additional buoyancy. This detrimental effect could be corrected by the displacement of ballast. However, this is troublesome and undesirable since trimming by ballast is anyway necessary for other purposes. Therefore, a preferred embodiment of the invention has an additional ballast tank the volume of which is tuned to the buoyancy of the pilot's cab arranged in the bow area of the hulls or the additional hull. Flooding or blowing of this additional ballast tank will then compensate imbalances of the craft in the longitudinal direction arising when the pilot's cab submerges or emerges. Such compensation may also be effected automatically.

As the craft is to be universally used for subsea work, it is provided or may be provided with a manipulator or a pipe gripping device. In a preferred arrangement, such a device is mounted rearwardly of the rearward transverse connection and covered during travel for streamlining purposes by a hinged fairing of the transverse connection. This location permits the attachment of a manipulator or pipe gripping device in addition to other work chambers disposed between the transverse connections. The hinged fairing which is anyway provided for the purpose of reducing the resistance to motion resulting from the transverse strut, protects the attached equipment and eliminates its naturally negative effects upon the resistance to motion.

Other details and improvements of the present invention will become apparent from the following description, in conjunction with the claims, of two embodiments illustrated in the simplified, diagrammatic drawing attached

DESCRIPTION OF THE INVENTION

Figure 1:
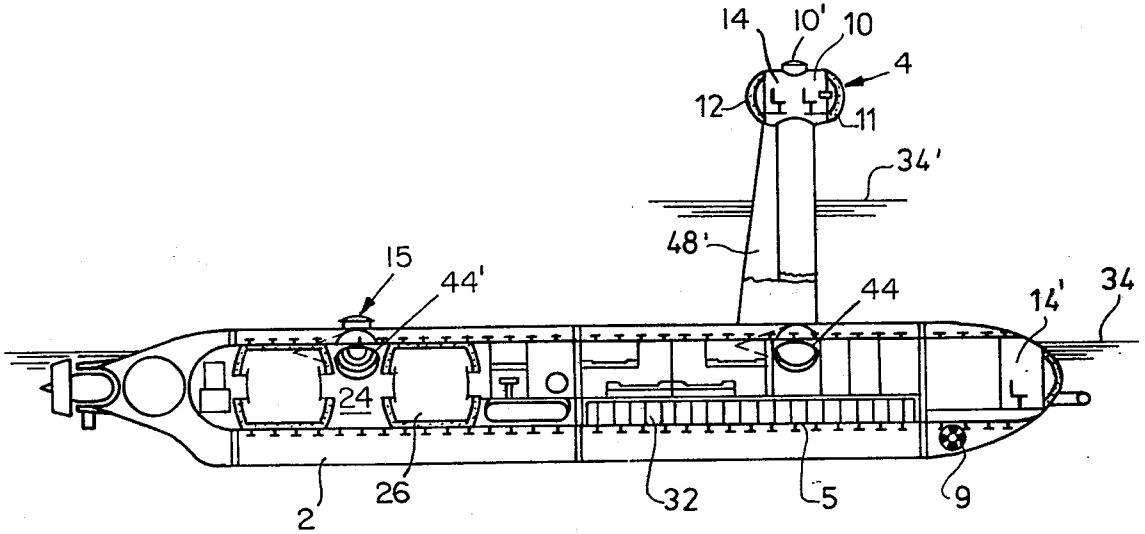
FIG. 1 shows, partly in side elevation and partly in longitudinal section, a twin-hull watercraft and a pilot's cab disposed above the hulls in accordance with the present invention.

The watercraft shown has two hulls 1 and 2 rigidly interconnected by means of transverse struts 3. The bow end transverse strut 3 carries a vertical strut 3' the upper end of which carries in turn a pilot's cab 4 taking the form of a pressure vessel. The two hulls 1 and 2 have outwardly the same shape, and each consists of an elongated, essentially cylindrical pressure vessel 5. Each of the pressure vessels 5 is surrounded by a fairing 8 which determines the outer shape of the hulls 1 and 2 and which at their after end carries propulsion means 6, while a side thruster 9 is provided in its bow end. The bow end of the pressure vessel 5 is formed by a hemispherical section 7 partly designed as a pressure-resistant view port. The struts 3 are constructed as pressure-resistant tubes which are joined at one end to the pressure vessel 5 and at the other end to the upper pressure vessel serving as pilot's cab 4. The pilot's cab 4 comprises a cylindrical, elongated body 10 with ingress/agress port 10' and whose two ends are provided each with a transparent hemispherical viewing section 11 and 12, respectively. The interior of the pressure vessel 10 comprises a control and work room 14. In addition, corresponding steering posts 14' are provided also at each of the bow ends of the cylindrical pressure vessels 5 in the area of the hemispherical sections 7.

At the aft transverse strut 3, a diver exit chamber 15 is provided which is accessible through the transverse strut. The diver exit chamber is provided at its bottom with an exit hatch 17, and on its top with docking means 17' that can be closed by a cover. These docking means serve for detachably attaching small submersible craft or for connecting an access to work chambers disposed between the hulls.

As mentioned before, the struts 3 and 3' are designed as man-sized tubes. The transverse struts 3 are arranged in the form of a portal comprising a horizontal central portion with adjacent short end portions which extend downwardly at an angle of 45° and which give access to the hulls via a closable hatch 44. The diver exit chamber 15 is also provided with hatches 44' inside the transverse struts 3. Thus, the struts 3 connect any part of the craft with any other part. Considering that the diver exit chamber 15 forms a tight separation between the two adjacent portions of the aft transverse struts 3, and considering further that the transverse struts 3 are designed as pressure-resistant bodies, it is possible to provide a transition for divers from the diver exit chamber 15 to decompression chambers 26 disposed in the starboard hull 2 in front of and behind the point where the transverse strut 3 opens into the cylindrical pressure vessel 5. Between the two decompression chambers 26, there is provided a chamber 24 which is accessible through the hatch 44 and from which access to the adjoining decompression chambers 26 is possible through corresponding hatches in bulk-heads 25. So, a diver may get from the water into one of the decompression chambers 26, without any change in pressure.

In the after area of the hull 1, a ball-shaped compressed-air tank 27 is provided between the pressure vessel 5 and the propulsion means 7. Likewise, a ball-shaped pressure tank 27' for helium (breathing gas for divers) is disposed in the same portion of the hull 2.

Figure 2:
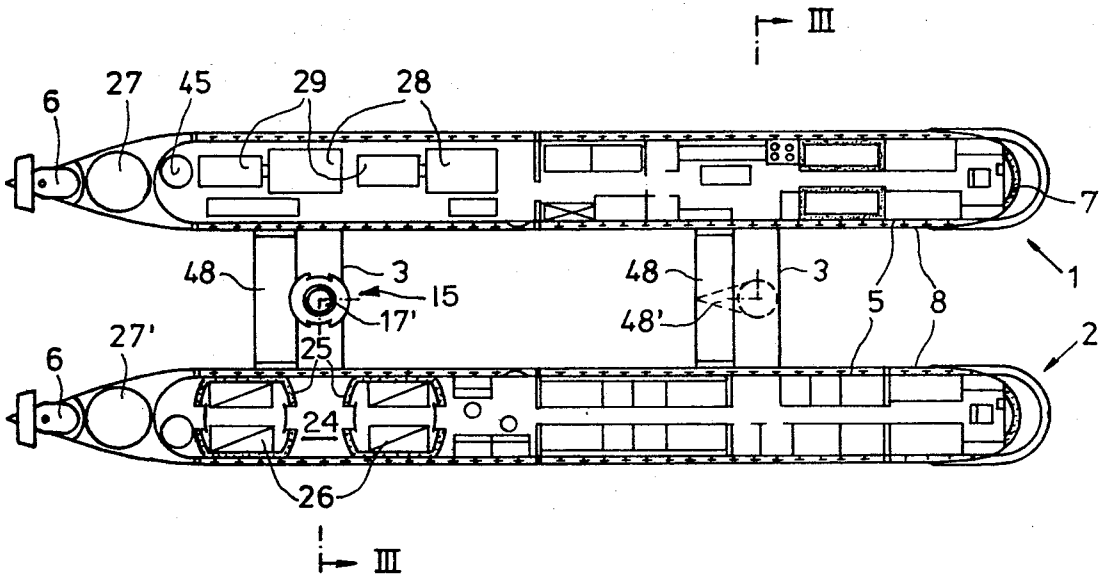
FIG. 2 shows a top plan view of the craft according to FIG. 1.
Figure 3:
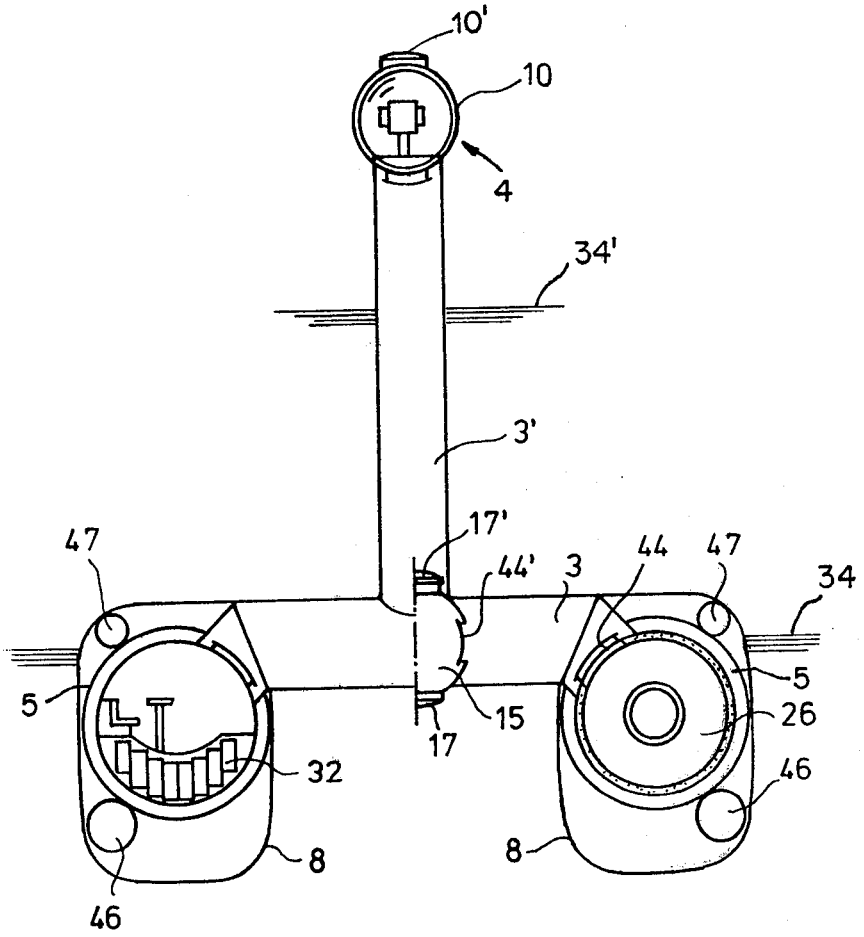
FIG. 3 is a section along line III—III in FIG. 2.

Within the cylindrical pressure vessel 5 of the hull 1, there is provided in a space closed off by bulk-heads a diesel combustion engine 28 driving an electric generator 29 which supplies the craft with power. Further, a hydraulic pump 45 is provided to supply the different propulsion means 6 and 9 and the other hydraulic working systems with the necessary energy. In surface operation or in semi-submerged operation, the internal-combustion engines can be used. In semi-submerged operation, the engine receives the necessary combustion air through an upwardly extending snorkel not shown in FIGS. 1 to 3. In completely submerged operation, however, the driving energy is obtained from batteries 32 disposed in the bilge area of the pressure vessel 5. In addition to the above equipment, the machine room also houses compressors, blowing pumps and other units necessary for the operation of the craft, while pressure tanks for oxygen, helium and air are provided adjacent the decompression chambers 26. The forward area of the hulls accommodates staff rooms and work rooms, storage tanks for breathing lime, air-conditioning equipment, control equipment and electronic equipment.

Beneath the cylindrical pressure vessels 5, ballast tanks 46 which may be flooded and blown are arranged within the fairing 8. Additional ballast tanks 47 are arranged above the cylindrical pressure vessel 5 and below a deck formed by the fairing 8.

In the surface position of the craft, a water-line 34 extends below the deck of the hulls 1 and 2 and a little below the horizontal tangent to the pressure vessels 5. Thus, the hulls 1 and 2 are largely submerged. The upper ballast tanks 47 and also the lower ballast tanks 46 are blown. In semi-submerged operation, the water-line 34' extends essentially in the middle of the clear distance between the hulls 1 and 2 and the pilot's cab 4. In this position, all of the lower ballast tanks 46 and part of the upper ballast tanks 47 are flooded.

The struts 3 are provided with fairings 48 or 48', respectively, giving a streamlined profile. The fairings may be either rigid or hinged. In the latter case, they may be designed to provide a streamlined protection and fairing during travel for working equipment—not shown in the drawing—arranged between the struts 3 or rearwardly of the after strut 3.

Figure 4:
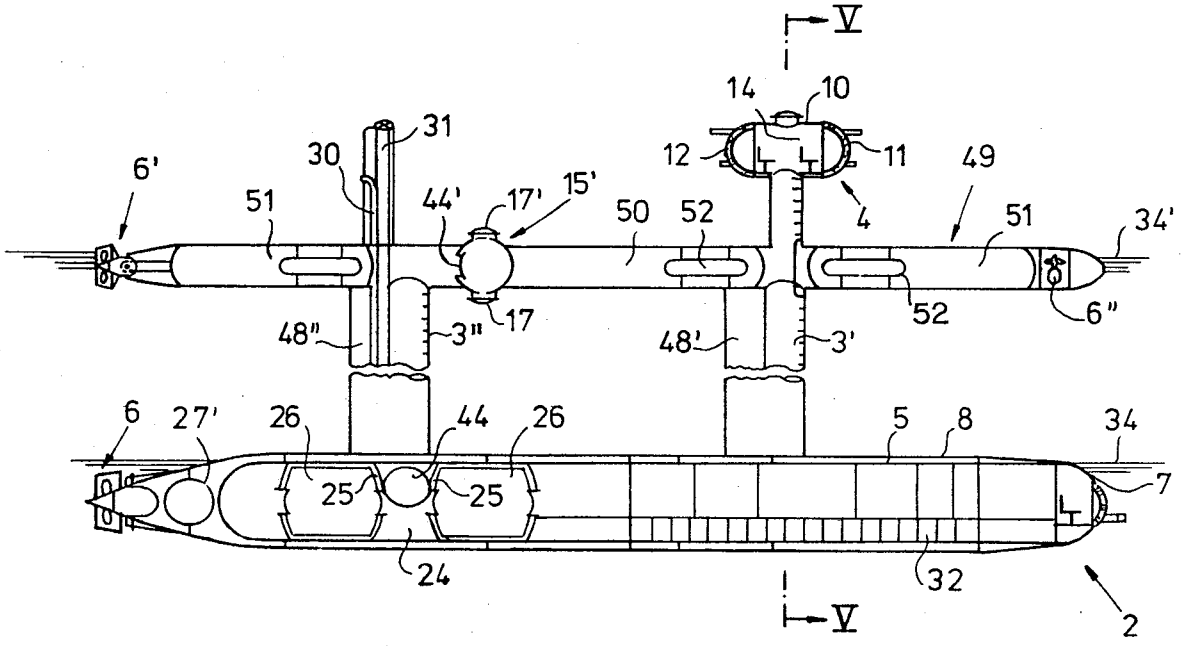
FIG. 4 shows, partly in side elevation and partly in longitudinal section, a twin-hull watercraft with an additional hull disposed substantially midway between the pilot's cab and the hull in accordance with the present invention.
Figure 5:
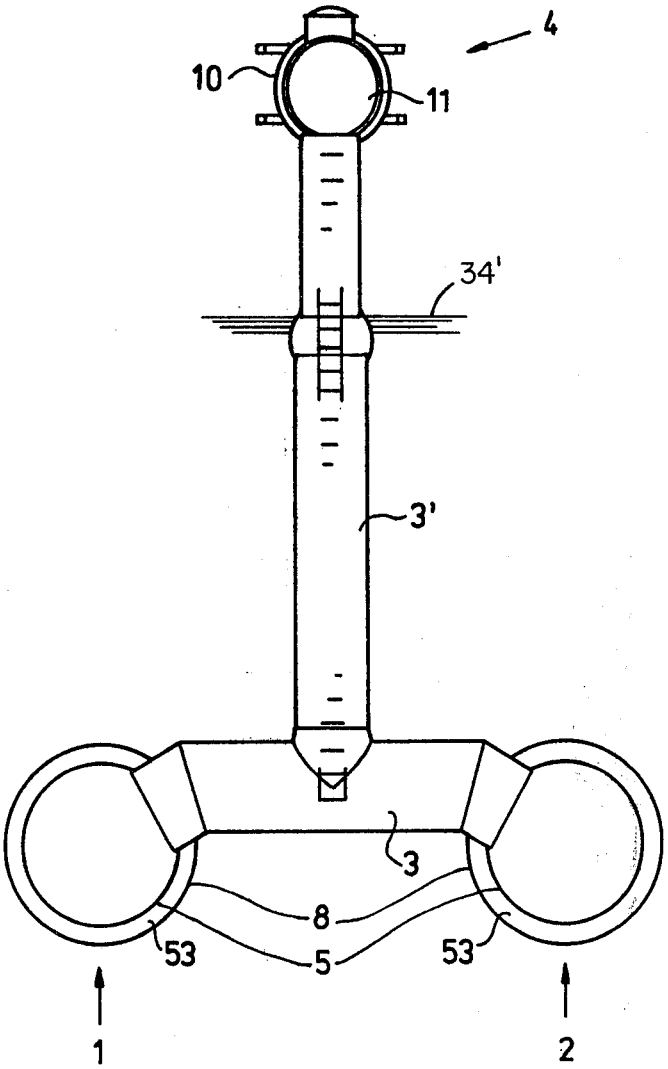
FIG. 5 is a section along line V—V.

In the embodiment shown in FIGS. 4 and 5, an additional vertical strut 3'' is provided in the area of the after transverse strut 3 instead of the diver exit chamber 15. An additional hull 49 extending parallel to the hulls 1, 2 and having a cross-section which is only little larger than the cross-section of the struts 3' and 3'' is disposed a little higher than midway between the hulls 1, 2 and the pilot's cab 4. The vertical strut 3'' ends at the additional hull 49. An air supply line 30 and/or a snorkel 31, which serve to supply the internal combustion engines 28 not shown in FIGS. 4 and 5 with the necessary combustion air, are guided through this vertical strut or through the adjoining fairing 48''.

Instead of the diver exit chamber 15, a diver exit chamber 15' is integrated into the additional hull 49 and set off a little towards the bow in relation to the rearward vertical strut 3''. The diver exit chamber 15' comprises also a lower exit hatch 17 and upper docking means 17'. Further, it is provided with a hatch 44' giving access from the diver exit chamber 15' to the additional hull 49 and from there via the vertical strut 3'' to the hulls 1,2 and, in particular, to one of the decompression chambers 26.

In the bow portion of the additional hull 49 vertical propulsion means 6'' are provided, while propulsion means 6' for turning the craft are disposed in the stern portion of the additional hull 49. The area between the diver exit chamber 15' and the forward vertical strut 3' serves as central control chamber 50 which can be flooded and blown. The portions of the additional hull 49 outside the area delimited by the two vertical struts 3' and 3'' are constructed as additional control chambers 51. Each of the three control chambers 50 and 51 accommodates a high-pressure compressed-air tank 52 which serves to blow the control chambers.

Between the fairing 8 and the cylindrical pressure vessels of the hulls 1 and 2, ballast tanks 53 which can be flooded and blown are disposed in concentric arrangement about the pressure vessels 5. The details of such ballast tanks are not shown.

In surface operation, the craft occupies a position defined by the water-line 34. In this position, the ballast tanks 53 and the control chambers 50 and 51 are blown. The behaviour of the craft in this condition is that of a form-stable catamaran. The hulls 1 and 2 are almost completely submerged; their fairing is designed to give only little resistance to underwater motion. In semi-submerged operation, the ballast tanks 53 are flooded, whereby the water-line 34' is obtained. The outer shape of the additional hull 49 is that of a surface-bound craft of great longitudinal extension, and the pilot's cab 4 is still several meters above the water-line 34'. Owing to the fact that in both operation modes only small cross-sectional areas are above the water-line and exposed to the motion of the sea, the wave resistance is low, both in surface operation and in semi-submerged operation.

What we claim is:

1. A twin-hull watercraft comprising two hulls disposed parallel to and spaced apart from each other, said hulls being rigidly and directly interconnected by at least a pair of hollow tubular transverse struts lying substantially in the plane of said hulls, a vertical hollow tubular superstructure extending upwardly from and communicating with the interior of one of said transverse struts along substantially the central longitudinal plane between said hulls, a pilot's cab disposed on said superstructure, said hulls and said struts being designed as pressure-resistant buoyancy bodies in that their weight is less than the weight of water displaced by them, said hulls being designed as tight pressure vessels of the submarine type and being provided with cells that may be flooded and blown, said pilot's cab being a pressure vessel buoyancy body in that its weight is less than the weight of water it displaces in the submerged condition, said hulls, struts and pilot's cab arranged to be weight-stable in the fully submerged condition and in the partially submerged condition wherein the pilot's cab is at least partly above the mean waterline whereby said watercraft can be used both as a form-stable surface-bound watercraft and as a weight-stable semi-submersible craft or a weight-stable submersible craft, and at least one egress means provided in at least one of the transverse struts and the pilot's cab.

2. The watercraft according to claim 1, wherein said transverse struts are connected to said hulls to be at least partially above the waterline when said watercraft is surfaced.

3. The watercraft according to claim 2, wherein a portal is defined between at least one of said transverse struts and said spaced hulls.

4. The watercraft according to claim 3 including fairings for said transverse struts.

5. The watercraft according to claim 4 wherein said fairings are hingedly connected to said transverse struts.

6. The watercraft according to claim 1 including docking means associated with at least one of said egress means for supporting accessory underwater equipment.

7. The watercraft according to claim 1 wherein each of said hulls comprises a cylindrical pressure vessel and is provided with a pair of ballast tanks mounted on the exterior thereof, one of ballast tanks being at the top of the hull and the other of said ballast tanks being at the bottom of the hull, said ballast tanks and hull being enclosed by a non-pressure resistant covering.

8. The watercraft according to claim 7 wherein said top ballast tank is above the waterline and the bottom ballast tank is below the waterline when surfaced and said top and bottom ballast tanks are sized so that in partial submergence of the watercraft, the lower ballast tank is filled and the upper ballast tank is only partially filled.

9. The watercraft according to claim 1 including a diver exit and entrance chamber having closeable ports located in association with at least one of said egress means.

10. A twin-hull watercraft comprising two hulls disposed parallel to and spaced apart from each other, said hulls being rigidly and directly interconnected by at least a pair of hollow tubular transverse struts lying substantially in the plane of said hulls, a vertical hollow tubular superstructure extending upwardly from and communicating with the interior of one of said transverse struts along substantially the central longitudinal plane between said hulls, a pilot's cab disposed on said superstructure, said hulls and said struts being designed as pressure-resistant buoyancy bodies in that their weight is less than the weight of water displaced by them, said hulls being designed as tight pressure vessels of the submarine type and being provided with cells that may be flooded and blown, said pilot's cab being a pressure vessel buoyancy body in that its weight is less than the weight of water it displaces in the submerged condition, said hulls, struts and pilot's cab arranged to be weight-stable in the fully submerged condition and in the partially submerged condition wherein the pilot's cab is at least partly above the mean waterline whereby said watercraft can be used both as a form-stable surface-bound watercraft and as a weight-stable semi-submersible craft or a weight-stable submersible craft, including a third hull comprising a pressure resistant buoyancy body having a weight less than the weight of the water displaced by it when fully submerged, said third hull being connected to said vertical superstructure above said pair of hulls so that when said pair of hulls are submerged, said third hull may be only partially submerged, and at least one egress means provided in at least said third hull and the pilot's cab.

11. The watercraft according to claim 10 wherein said third hull is located on said superstructure midway between said pair of hulls and said pilot's cab.

12. The watercraft according to claim 10 or 11 wherein said third hull is elongate and has the shape of a surface bound craft.

13. The watercraft according to claim 10 including egress means located in said third hull having an associated diver exit and entrance chamber having closeable ports.

14. The watercraft according to claim 10 wherein said third hull is provided with control cells for regulating the position of the watercraft relative to the waterline when said watercraft is partially submerged.

15. The watercraft according to claim 10 wherein each of said pair of hulls comprises a cylindrical pressure vessel, said pressure vessel being surrounded by a concentrically arranged ballast tank and a non-pressure resistant covering defining the outer configuration and wherein said third hull contains control cells.

16. The watercraft according to claim 15 wherein said ballast tanks and control cells are dimensioned so that the watercraft is semi-submerged when the ballast tanks are flooded and the control cells are blown.

17. The watercraft according to claim 16 wherein the volume of the control cells is larger than the buoyancy of the watercraft in its semi-submerged position and that flooding of the control cells will submerge the craft.

* * * * *